US011326237B2

(12) United States Patent
Fujioka et al.

(10) Patent No.: US 11,326,237 B2
(45) Date of Patent: May 10, 2022

(54) AUSTENITIC WEAR-RESISTANT STEEL PLATE

(71) Applicant: NIPPON STEEL CORPORATION, Tokyo (JP)

(72) Inventors: Masaaki Fujioka, Tokyo (JP); Tetsuya Namegawa, Tokyo (JP); Masahide Yoshimura, Tokyo (JP); Masanori Minagawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 335 days.

(21) Appl. No.: 16/495,732

(22) PCT Filed: Mar. 29, 2018

(86) PCT No.: PCT/JP2018/013281

§ 371 (c)(1),
(2) Date: Sep. 19, 2019

(87) PCT Pub. No.: WO2019/186906

PCT Pub. Date: Oct. 3, 2019

(65) Prior Publication Data

US 2021/0355569 A1 Nov. 18, 2021

(51) Int. Cl.

| | |
|---|---|
| ***C22C 38/38*** | (2006.01) |
| ***C22C 38/02*** | (2006.01) |
| ***C22C 38/04*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/24*** | (2006.01) |
| ***C22C 38/28*** | (2006.01) |

(52) U.S. Cl.

CPC ..... *C22C 38/38* (2013.01); *C21D 6/005* (2013.01); *C21D 8/0205* (2013.01); *C21D 8/0226* (2013.01); *C21D 8/0263* (2013.01); *C21D 9/46* (2013.01); *C22C 38/001* (2013.01); *C22C 38/004* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/28* (2013.01); *C21D 2211/001* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2011/0308673 | A1 | 12/2011 | Schneider et al. | |
| 2014/0261918 | A1* | 9/2014 | Jin | C22C 38/02 148/620 |
| 2015/0354037 | A1 | 12/2015 | Lee et al. | |
| 2017/0114425 | A1 | 4/2017 | Katagiri et al. | |
| 2017/0233855 | A1 | 8/2017 | Park et al. | |
| 2017/0362675 | A1 | 12/2017 | Lee et al. | |

FOREIGN PATENT DOCUMENTS

| | | | |
|---|---|---|---|
| CN | 101717889 | A | 6/2010 |
| CN | 103981450 | A | 8/2014 |
| CN | 104451405 | A | 3/2016 |
| JP | 48-38822 | A | 6/1973 |
| JP | 56-263 | A | 1/1981 |
| JP | 57-17937 | B2 | 4/1982 |
| JP | 60-56056 | A | 4/1985 |
| JP | 62-139855 | A | 6/1987 |
| JP | 63-8181 | B2 | 2/1988 |
| JP | 1-14303 | B2 | 3/1989 |
| JP | 1-142058 | A | 6/1989 |
| JP | 2-15623 | B2 | 4/1990 |
| JP | 6-306456 | A | 11/1994 |
| JP | 11-61339 | A | 3/1999 |
| JP | 2007-126715 | A | 5/2007 |
| JP | 2007126715 | A * | 5/2007 |

(Continued)

OTHER PUBLICATIONS

Extended European Search Report dated May 13, 2020, for counterpart European Patent Application No. 18909269.5.
"High manganese steel castings", JIS G 5131, 2008, total 41 pages.
"Metallic materials—Tensile testing—Method of test at room temperature", JIS Z 2241, 2011, total 169 pages.
"Method of Charpy pendulum impact test of metallic materials", JIS Z 2242, 2005, total 70 pages.
"Molding silica sand", JIS G 5901, 2016, total 23 pages.
"Rolled steels for general structure", JIS G 3101, 2015, total 30 pages.
"Steels—Micrographic determination of the apparent grain size", JIS G 0551, 2013, total 90 pages.
International Search Report for PCT/JP2018/013281 dated Jun. 26, 2018.

(Continued)

*Primary Examiner* — Jenny R Wu
(74) *Attorney, Agent, or Firm* — Birch, Stewart, Kolasch & Birch, LLP

(57) ABSTRACT

An austenitic wear-resistant steel plate according to an aspect of the present invention has a predetermined chemical composition, amounts of C and Mn by mass % satisfy $-13.75\times C+16.5\leq Mn\leq -20\times C+30$, the volume fraction of austenite in a metallographic structure is 40% or more and less than 95%, and the average grain size of the austenite is 40 to 300 μm.

10 Claims, No Drawings

(56) References Cited

FOREIGN PATENT DOCUMENTS

| | | | |
|---|---|---|---|
| JP | 2011-219809 | A | 11/2011 |
| JP | 2012-107325 | A | 6/2012 |
| JP | 2014-194042 | A | 10/2014 |
| JP | 2016-507648 | A | 3/2016 |
| JP | 2016-196703 | A | 11/2016 |
| JP | 6252715 | B1 | 12/2017 |
| KR | 10-2016-0006166 | A | 1/2016 |
| SU | 929735 | A1 | 5/1982 |
| WO | WO 2014/149732 | A1 | 9/2014 |
| WO | WO 2015/147166 | A1 | 10/2015 |

OTHER PUBLICATIONS

Written Opinion of the International Searching Authority for PCT/JP2018/013281 (PCT/ISA/237) dated Jun. 26, 2018.
Chinese Office Action and Search Report, dated Feb. 21, 2020, for corresponding Chinese Application No. 201880022906.X, with English translations.
Korean Office Action dated Oct. 4, 2019 for Application No. 10-2019-7027564, along with an English translation.

* cited by examiner

AUSTENITIC WEAR-RESISTANT STEEL PLATE

TECHNICAL FIELD OF THE INVENTION

The present invention relates to an austenitic wear-resistant steel plate used for a wear-resistant member.

RELATED ART

A steel plate for wear-resistant members in the related art is manufactured by hardening a steel containing about 0.1% to 0.3% of C as disclosed in Patent Document 1 or the like to cause the metallographic structure to contain martensite. Such a steel plate has a Vickers hardness as significantly high as about 400 to 600 Hv and is excellent in wear resistance. However, the martensite structure is so hard that is inferior in bending workability and toughness. Moreover, although the steel plate for wear-resistant members in the related art contains C in a large amount in order to increase hardness, a C content of 0.2% or more causes a possibility of weld cracking.

On the other hand, high Mn cast steel has been used as a material having both wear resistance and ductility. The high Mn cast steel has good ductility and toughness because the matrix is austenite. However, the high Mn cast steel has a characteristic that, when the surface portion undergoes plastic deformation due to a collision with a rock or the like, deformation twinning or, under certain conditions, a strain-induced martensitic transformation occurs, and only the hardness of the surface portion significantly increases. Therefore, the high Mn cast steel remains austenitic in the central part even when the wear resistance of the impact surface (surface portion) is improved and thus can be maintained in a state of being excellent in ductility and toughness.

As the high Mn cast steel, steels defined in JIS G 5131 and austenitic wear-resistant steels in which the mechanical properties and wear resistance are improved by increasing the C content and the Mn content have been proposed. (refer to Patent Documents 2 to 8 and the like).

In many cases, these high Mn cast steels contain C in an amount as large as 1% or more in order to improve wear resistance. In a steel having a C content of 1% or more, even if austenite excellent in ductility and toughness is formed, there may be cases where the ductility and toughness decrease due to the precipitation of a large amount of carbides and the like. When the C content is excessively reduced for the purpose of improving ductility and toughness, it is necessary to add a large amount of Mn in order to stabilize austenite, and there is a disadvantage that alloy cost becomes excessive.

Patent Document 9 proposes a method of manufacturing a high Mn cast steel mainly utilizing strain-induced martensite as a method for avoiding the addition of a large amount of Mn and C. The main mechanism for improving the wear resistance of the high C, high Mn austenitic wear-resistant steel described above is that twinning deformation of austenite is caused by strong strain introduced to the surface portion of the steel during a collision with a rock or the like and thus significant strain-induced hardening occurs on the surface portion of the steel. The method described in Patent Document 9 is to improve the wear resistance of steel by mainly transforming austenite into high carbon martensite by strong strain of the surface portion of the steel. Martensite containing a large amount of carbon is known to increase in hardness in proportion to the amount of C, and is a very hard structure. Therefore, according to the method described in Patent Document 9, the amount of C can be reduced compared to the austenitic wear-resistant steel. Furthermore, according to the method described in Patent Document 9, since austenite does not need to be stabilized as much as the austenitic wear-resistant steel does, it is possible to reduce the amount of Mn.

However, Patent Document 9 requires a complex and long-time heat treatment including a step of performing a homogenization treatment at 850° C. to 1200° C. for 0.5 to 3 hours, a step of performing cooling to 500° C. to 700° C., a step of performing a pearlitizing treatment for 3 to 24 hours, a step of performing an austenitizing treatment for hailing again to 850° C. to 1200° C., and thereafter a step of performing water cooling.

PRIOR ART DOCUMENT

Patent Documents

[Patent Document 1] Japanese Unexamined Patent Application, First Publication No. 2014-194042

[Patent Document 2] Japanese Examined Patent Application, Second Publication No. S57-17937

[Patent Document 3] Japanese Examined Patent Application, Second Publication No. S63-8181

[Patent Document 4] Japanese Examined Patent Application, Second Publication No. H1-14303

[Patent Document 5] Japanese Examined Patent Application, Second Publication No. H2-15623

[Patent Document 6] Japanese Unexamined Patent Application, First Publication No. S60-56056

[Patent Document 7] Japanese Unexamined Patent Application, First Publication No. S62-139855

[Patent Document 8] Japanese Unexamined Patent Application, First Publication No. H1-142058

[Patent Document 9] Japanese Unexamined Patent Application, First Publication No. H1-61339

DISCLOSURE OF THE INVENTION

Problems to be Solved by the Invention

The present invention has been made in view of such circumstances, and an object thereof is to provide an austenitic wear-resistant steel plate which is excellent in wear resistance and strength and excellent in toughness and ductility which conflict therewith.

Means for Solving the Problem

In order to improve the wear resistance and the strength of an austenitic wear-resistant steel plate, it is preferable that a large amount of hard α' martensite and ε martensite is contained in austenite. However, there may be cases where when α' martensite and ε martensite is excessively contained, the toughness and ductility of the austenitic wear-resistant steel plate deteriorate. In order to obtain the wear resistance, strength, toughness, and ductility of the austenitic wear-resistant steel plate, a structure primarily containing an austenite phase needs to be formed at a temperature at which the austenitic wear-resistant steel plate is used. Furthermore, it is preferable to have a structure including α' martensite and ε martensite in steel, and the structure does not excessively include the above structures. In order to realize such a structure, it is necessary to adjust the chemical composition of the steel and to control the stability of austenite to an appropriate degree.

In order to further improve the wear resistance of the austenitic wear-resistant steel plate, it is necessary to significantly increase the hardness of the surface portion of the steel plate by causing significant strain-induced hardening to occur on the surface portion of the steel plate by causing twinning deformation by plastic deformation due to a collision with a rock or the like by increasing the C content to about 1%, or by generating hard martensite through strain-induced martensitic transformation. Since the hardness of martensite containing a large amount of carbon is high, causing the strain-induced martensitic transformation to occur on the surface portion of the steel plate significantly improves the wear resistance of the austenitic wear-resistant steel plate. From this viewpoint, it is necessary to control the stability of austenite so that strain-induced martensitic transformation occurs at the time of a collision with a rock or the like even when the structure of the austenitic wear-resistant steel plate is a structure that primarily contains austenite during manufacturing. For this purpose, the amount of C and Mn is controlled.

In order to improve the toughness of the steel plate, the refinement of austenite grains (hereinafter, sometimes simply referred to as "grains") is extremely effective, and this can be achieved by hot rolling. The refinement of grains has an effect of improving the toughness in proportion to "the −½ power of grain size" as is known from the Hall-Petch relationship or the like. However, excessive refinement has a disadvantage of increasing the amount of carbides precipitated at grain boundaries by increasing the nucleation sites of carbides formed at austenite grain boundaries. The carbides at grain boundaries are very hard, and when the amount of the precipitated carbides increases, the toughness and ductility of the steel decrease. The present inventors found that the toughness and ductility of the steel plate can be improved by achieving the refinement of grains without excessively reducing the grain size.

As described above, the present invention provides the following austenitic wear-resistant steel plate by appropriately controlling the chemical composition of the steel plate and achieving the refinement of grains of the steel plate through hot rolling.

[1] An austenitic wear-resistant steel plate according to an aspect of the present invention includes, as a chemical composition, by mass %:

C: 0.2% to 1.6%;
Si: 0.01% to 2.00%;
Mn: 2.5% to 30.0%;
P: 0.050% or less;
S: 0.0100% or less;
Cu: 0% to 3.0%;
Ni: 0% to 3.0%;
Co: 0% to 3.0%;
Cr: 0% to 5.0%;
Mo: 0% to 2.0%;
W: 0% to 2.0%;
Nb: 0% to 0.30%;
V: 0% to 0.30%;
Ti: 0% to 0.30%;
Zr: 0% to 0.30%;
Ta: 0% to 0.30%;
B: 0% to 0.300%;
Al: 0.001% to 0.300%;
N: 0% to 1.000%;
O: 0.0% to 0.0100%;
Mg: 0% to 0.0100%;
Ca: 0% to 0.0100%;
REM: 0% to 0.0100%; and
a remainder including Fe and impurities, in which, when amounts of C and Mn by mass % are respectively referred to as C and Mn, the amounts of C and Mn satisfy $-13.75\times C+16.5\leq Mn\leq -20\times C+30$, a metallographic structure includes, by volume fraction, austenite: 40% or more and less than 95%, and an average grain size of the austenite is 40 to 300 μm.

[2] In the austenitic wear-resistant steel plate according to [1], the chemical composition may satisfy the following formula, $$-C+0.8\times Si-0.2\times Mn-90\times(P+S)+1.5\times(Cu+Ni+Co)+3.3\times Cr+9\times Mo+4.5\times W+0.8\times Al+6\times N+1.5\geq 3.2$$

where a symbol for each of elements in the formula represents an amount of the corresponding element by mass %.

[3] In the austenitic wear-resistant steel plate according to [1] or [2], the metallographic structure may include, by volume fraction:

ε martensite: 0% to 60%; and
α martensite: 0% to 60%, and
a sum of the ε martensite and the α' martensite may be 5% to 60%.

[4] In the austenitic wear-resistant steel plate according to any one of [1] to [3], the chemical composition may include, by mass %, 0.0001% to 0.0100% of O, and a sum of a Mg content, a Ca content, and a REM content may be 0.0001% to 0.0100%.

[5] In the austenitic wear-resistant steel plate according to [4], the chemical composition may include, by mass %, 0.0001% to 0.0050% of S, and amounts of O and S by mass % may satisfy $O/S\geq 1.0$.

[6] In the austenitic wear-resistant steel plate according to any one of [1] to [5], as the chemical composition, when the amounts of C and Mn by mass % are respectively referred to as C and Mn, the amounts of C and Mn may satisfy $-6.5\times C+16.5\leq Mn\leq -20\times C+30$.

[7] In the austenitic wear-resistant steel plate according to any one of [1] to [6], the chemical composition may include, by mass %, 0% to 0.2% of Cu.

Effects of the Invention

According to the aspect of the present invention, it is possible to provide an austenitic wear-resistant steel plate (hereinafter, simply referred to as "steel plate") which is excellent in wear resistance and strength and excellent in toughness and ductility which conflict therewith. Specifically, according to the aspect of the present invention, it is possible to provide a steel plate excellent in wear resistance and strength and excellent in toughness and ductility by appropriately controlling the chemical composition, appropriately controlling the metallographic structure through hot rolling, and achieving the refinement of grains of the steel plate. The steel plate according to the present invention can be manufactured to a width of about 5 m and a length of about 50 m with various plate thicknesses ranging from about 3 mm to about 200 mm. Therefore, the steel plate according to the present invention is not limited to a relatively small wear-resistant member to which an impact is applied, such as a crusher liner, and can also be used as a very large member for a construction machine and a wear-resistant structural member. Moreover, according to the steel plate according to the present invention, steel pipes and shaped steels having similar characteristics to the steel plate according to the present invention can also be manufactured. Furthermore, according to a preferable aspect of the present invention, coarsening of grains in a welding can be suppressed using oxysulfides, so that it is possible to provide a steel plate excellent also in the toughness of the weld.

EMBODIMENTS OF THE INVENTION

Hereinafter, an austenitic wear-resistant steel plate according to an embodiment will be described in detail. In the present embodiment, a steel plate having a structure primarily containing high hardness austenite as described above or utilizing martensitic transformation of the austenite structure is defined as austenitic wear-resistant steel. Specifically, a steel plate having an austenite volume fraction of 40% or more and less than 95% is defined as an austenitic wear-resistant steel plate.

First, the reason for limiting each of elements contained in the austenitic wear-resistant steel plate according to the present embodiment will be described. In addition, "%" regarding the amount of an element means "mass %" unless otherwise specified.

C: 0.2% to 1.6%

C stabilizes austenite and improves wear resistance. In order to improve the wear resistance of the steel plate, the C content needs to be 0.2% or more. In a case where particularly high wear resistance is required, the C content is preferably 0.3% or more, 0.5% or more, 0.6% or more, or 0.7% or more. On the other hand, when the C content exceeds 1.6%, a large amount of coarse carbides are formed in the steel, and the steel plate cannot achieve high toughness. Therefore, the C content is set to 1.6% or less. The C content is more preferably set to 1.4% or less, or 1.2% or less. For a further improvement in the toughness, the C content may be 1.0% or less, or 0.8% or less.

Si: 0.01% to 2.00%

Si is typically a deoxidizing element and a solid solution strengthening element, but has an effect of suppressing the formation of carbides of Cr and Fe. The present inventors conducted various examinations on the elements that suppress the formation of carbides, and found that the formation of carbides is suppressed by including a predetermined amount of Si. Specifically, the present inventors found that the formation of carbide is suppressed by setting the Si content to 0.01 to 2.00%. When the Si content is less than 0.01%, the effect of suppressing the formation of carbides is not obtained. On the other hand, when the Si content exceeds 2.00%, there may be cases where coarse inclusions are formed in the steel and thus the ductility and toughness of the steel plate deteriorate. The Si content is preferably set to 0.10% or more, or 0.30% or more. In addition, the Si content is preferably set to 1.50% or less, or 1.00% or less.

Mn: 2.5% to 30.0%, $-13.75\times C+16.5\leq Mn\leq -20\times C+30$

Mn is an element that stabilizes austenite together with C. The Mn content is set to 2.5 to 30.0%. In order to improve austenite stabilization, the Mn content is preferably set to 5.0% or more, 10.0% or more, 12.0% or more, or 15.0% or more. The Mn content is preferably set to 25.0% or less, 20.0% or less, or 18.0% or less.

From the viewpoint of austenite stabilization, the Mn content is set to, in relation to the C content, $-13.75\times C+16.5$(%) or more and $-20\times C+30$(%) or less (that is, $-13.75\times C+16.5\leq Mn\leq -20\times C+30$). This is because when the Mn content is less than $-13.75\times C+16.5$(%) in relation to the C content, the volume fraction of austenite becomes less than 40%. In addition, when the Mn content is more than $-20\times C+30$(%) in relation to the C content, the volume fraction of austenite becomes more than 95%.

In order to maintain better ductility and toughness, the Mn content is preferably set to, in relation to the C content, $-6.5\times C+16.5$(%) or more and $-20\times C+30$(%) or less (that is, $-6.5\times C+16.5\leq Mn\leq -20\times C+30$). By controlling the relationship between the Mn content and the C content to the above range, it is possible to reduce the volume fraction of martensite contained in the steel plate structure, particularly $\alpha'$ martensite, and thus the ductility and toughness of the steel plate can be significantly improved. Since the influence of C on austenite stabilization is very large, in the steel plate according to the present embodiment, the relationship between the Mn content and C content mentioned above is particularly important.

P: 0.050% or Less

P segregates at grain boundaries and reduces the ductility and toughness of the steel plate, so that it is preferable to reduce the amount of P much as possible. Therefore, the P content is set to 0.050% or less. The P content is preferably set to 0.030% or less or 0.020% or less. P is generally incorporated as impurities from scraps or the like during molten steel production, but the lower limit thereof is not particularly limited and is 0%. However, when the P content is excessively reduced, there may be cases where the manufacturing cost increases. Therefore, the lower limit of the P content may be set to 0.001% or more, or 0.002% or more.

S: 0.0100% or Less

S is an impurity, and when S is contained excessively, S segregates at grain boundaries or forms coarse MnS, thereby reducing the ductility and toughness of the steel plate. Therefore, the S content is set to 0.0100% or less. The S content is preferably set to 0.0060% or less, 0.0040% or less, or 0.0020% or less. The lower limit of the S content is 0%. As will be described later, S has an effect of improving the toughness of the steel plate, particularly the toughness of a heat-affected zone (HAZ) by forming fine oxysulfides in the steel with O and Mg, Ca, and/or rare-earth metals (REM) and thus suppressing the growth of austenite grains. In order to obtain the effect, the S content may be set to 0.0001% or more, 0.0005% or more, or 0.0010% or more. In the present embodiment, "oxysulfides" include not only a compound containing both O and S but also oxides and sulfides.

The steel plate according to the present embodiment further includes, in addition to the essential elements mentioned above, one or two or more of Cu, Ni, Co, Cr, Mo, W, Nb, V, Ti, Zr, Ta, B, N, O, Mg, Ca, and REM. These elements are not necessarily contained, and the lower limits of the amounts of all the elements are 0%. In addition, Al, which will be mentioned later, is not an optional element but an essential element.

Cu: 0% to 3.0%, Ni: 0% to 3.0%, and Co: 0% to 3.0%

Cu, Ni, and Co improve the toughness of the steel plate and stabilize austenite. However, when the amount of at least one of Cu, Ni, and Co exceeds 3.0%, the effect of improving the toughness of the steel plate is saturated, and the cost also increases. Therefore, in a case where these elements are contained, the amount of each of the elements is set to 3.0% or less. Each of the Cu content, the Ni content, and the Co content is preferably set to 2.0% or less, 1.0% or less, 0.5% or less, or 0.3% or less. In particular, the Cu content is more preferably set to 0.2% or less. For austenite stabilization, the Cu content may be set to 0.02% or more, 0.05% or more, or 0.1% or more, and each of the Ni content and the Co content may be set to 0.02% or more, 0.05% or more, 0.1% or more, or 0.2% or more.

Cr: 0% to 5.0%

Cr improves the strain hardening property of the steel. When the Cr content exceeds 5.0%, precipitation of intergranular carbides is promoted, and the toughness of the steel plate is reduced. Therefore, the Cr content is set to 5.0% or less. The Cr content is preferably set to 2.5% or less, or 1.5% or less. In order to improve the strain hardening property, the Cr content may be set to 0.05% or more, or 0.1% or more.

Mo: 0% to 2.0%, and W: 0% to 2.0%

Mo and W strengthen the steel, reduce the activity of C in the austenite phase, and thus suppress the precipitation of carbides of Cr and Fe precipitated at austenite grain boundaries, thereby improving the toughness and ductility of the steel plate. However, even though Mo and W are contained excessively, the above effect is saturated, but the cost increases. Therefore, each of the Mo content and the W content is set to 2.0% or less. Each of the Mo content and the W content is preferably set to 1.0% or less, 0.5% or less, or 0.1% or less. In order to reliably obtain the effects, each of the Mo content and the W content may be set to 0.01% or more, 0.05% or more, or 0.1% or more.

Nb: 0% to 0.30%, V: 0% to 0.30%, Ti: 0% to 0.30%, Zr: 0% to 0.30%, and Ta: 0% to 0.30%

Nb, V, Ti, Zr, and Ta form precipitates such as carbonitrides in the steel. These precipitates improve the toughness of the steel by suppressing the coarsening of grains during solidification of the steel. Moreover, the elements reduce the activity of C and N in austenite, and thus suppresses the formation of carbides, such as cementite and graphite. Furthermore, the above elements strengthen the steel by solid solution strengthening or precipitation hardening.

When at least one of the Nb content, the V content, the Ti content, the Zr content, and the Ta content exceeds 0.30%, there may be cases where the precipitates become significantly coarsened and the ductility and toughness of the steel plate decrease. Therefore, each of the Nb content, the V content, the Ti content, the Zr content, and the Ta content is set to 0.30% or less, and more preferably 0.20% or less, 0.10% or less, or 0.01% or less. Furthermore, it is more preferable to set the sum of the Nb content, the V content, the Ti content, the Zr content, and the Ta content to 0.30% or less, or 0.20% or less. For the improvement in the toughness of the steel and high-strengthening, each of the Nb content and the V content may be set to 0.005% or more, 0.01% or more, or 0.02% or more. For the same reason, each of the Ti content, the Zr content, and the Ta content may be set to 0.001% or more or 0.01% or more.

B: 0% to 0.300%

B segregates at austenite grain boundaries and thus suppresses intergranular fracture, thereby improving the proof stress and ductility of the steel plate. However, when the B content exceeds 0.300%, there may be cases where the toughness of the steel plate deteriorates. Therefore, the B content is set to 0.300% or less. The B content is preferably set to 0.250% or less. In order to suppress intergranular fracture, the B content may be set to 0.0002% or more, or 0.001% or more.

Al: 0.001% to 0.300%

Al is a deoxidizing element and is a solid solution strengthening element, but similarly to Si, suppresses the formation of carbides of Cr and Fe. The present inventors conducted various examinations on the elements that suppress the formation of carbides, and as a result, found that the formation of carbides is suppressed when the Al content is equal to or more than a predetermined amount. Specifically, the present inventors found that the formation of carbides is suppressed by setting the Al content to 0.001 to 0.300%. When the Al content is less than 0.001%, the effect of suppressing the formation of carbides is not obtained. On the other hand, when the Al content exceeds 0.300%, there may be cases where coarse inclusions are formed and thus the ductility and toughness of the steel plate deteriorate. The Al content is preferably set to 0.003% or more, or 0.005% or more. In addition, the Al content is preferably set to 0.250% or less or 0.200% or less.

N: 0% to 1.000%

N is an element effective for stabilizing austenite and improving the proof stress of the steel plate. N has the same effect as C as an element for austenite stabilization. N does not have an adverse effect such as toughness deterioration due to grain boundary precipitation, and the effect of N increasing the strength at extremely low temperatures is greater than C. N also has an effect of dispersing fine nitrides in the steel by coexistence with nitride forming elements. When the N content exceeds 1.000%, there may be cases where the toughness of the steel plate significantly deteriorates. Therefore, the N content is set to 1.000% or less. The N content is more preferably set to 0.300% or less, 0.100% or less, or 0.030% or less. N is incorporated as an impurity in a certain amount in some cases, but the N content may be set to 0.003% or more for the high-strengthening described above and the like. The N content is more preferably set to 0.005% or more, 0.007% or more, or 0.010% or more.

O: 0% to 0.0100%

O is incorporated into the steel as an impurity in a certain amount, but O has an effect of increasing the toughness by refining the grains in the HAZ. On the other hand, when the O content exceeds 0.0100%, there may be cases where the ductility and toughness in the HAZ decrease due to the coarsening of oxides and the segregation to grain boundaries. Therefore, the O content is set to 0.0100% or less. The O content is more preferably set to 0.0070% or less or 0.0050% or less. In order to increase the toughness, the O content may be set to 0.0001% or more, or 0.0010% or more.

Mg: 0% to 0.0100%, Ca: 0% to 0.0100%, and REM: 0% to 0.0100%

Mg, Ca, and REM are formed in a large amount in high Mn steel and suppress the formation of MnS which significantly reduces the ductility and toughness of the steel plate.

On the other hand, when the amounts of these elements are excessive, a large amount of coarse inclusions are formed in the steel, which causes deterioration of the ductility and toughness of the steel plate. Therefore, each of the Mg content, the Ca content, and the REM content is set to 0.0100% or less. Each of the Mg content, the Ca content, and the REM content is more preferably 0.0070% or less or 0.0050% or less. In order to suppress the formation of MnS, each of the Mg content, the Ca content, and the REM content may be set to 0.0001% or more. Each of the Mg content, the Ca content, and the REM content may be set to 0.0010% or more, or 0.0020% or more.

In addition, rare-earth metals (REM) mean a total of 17 elements including Sc, Y, and lanthanides. The amount of REM means the sum of the amounts of these 17 elements.

O: 0.0001% to 0.0100%, and Sum of Mg Content, Ca Content, and REM Content: 0.0001% to 0.0100%

For the reasons described below, in addition to the O content being set to 0.0001% to 0.0100%, it is preferable to set the sum of the Mg content, the Ca content, and the REM content to 0.0001% to 0.0100%. That is, the amount of at least one element of Mg, Ca, and REM is preferably set to 0.0001% to 0.0100%. At this time, the O content may be set to 0.0002% or more, and set to 0.0050% or less. The sum of the Mg content, the Ca content, and the REM content may be set to 0.0003% or more, 0.0005% or more, or 0.0010% or more, and may be set to 0.0050% or less, or 0.0040% or less.

The reason why the O content is set to 0.0001% or more and the sum of the Mg content, the Ca content, and the REM content is set to 0.0001% to 0.0100% is that coarsening of grains in the HAZ of the steel plate is prevented by forming oxides of Mg, Ca, and/or REM. Under standard welding conditions, the austenite grain size of the HAZ obtained by the austenite pinning effect of grain growth by the oxides is several tens μm to 300 μm and docs not exceed 300 μm (However, a case where the austenite grain size of the steel plate (base metal) exceeds 300 μm is excluded). As described above, in order to control the austenite grain size of the steel plate including the HAZ to 300 μm or less, it is preferable that the above elements (O, Mg, Ca, and REM) are included.

S: 0.0001% to 0.0050%, O/S≥1.0

S forms oxysulfides with O and Mg, Ca, and/or REM and is thus an element effective for grain refinement. Therefore, in a case where S is contained in the steel together with O and Mg, Ca, and/or REM, in order to obtain the effect of increasing the toughness through refinement of grains in the HAZ, the S content preferably set to 0.0001% or more. In a case where S is contained in the steel together with O and Mg, Ca, and/or REM, in order to obtain better ductility and toughness for the steel plate, the S content is preferably set to 0.0050% or less.

In a case where S is contained together with O and Mg, Ca, and/or REM in the steel, by causing the S content and the O content to satisfy a relationship of O/S≥1.0, the effect of increasing the toughness through refinement of grains in the HAZ can be significantly exhibited. Since sulfides are thermally unstable compared to oxides, when the proportion of S in precipitated particles increases, there may be cases where pinning particles which are stable at high temperatures cannot be secured. Therefore, in a case where the O content is set to 0.0001% to 0.0100%, the sum of the Mg content, the Ca content, and the REM content is set to 0.0001% to 0.0100%, and S is contained in the steel, it is preferable that the S content is set to 0.0001% to 0.0050% and the O content and the S content are set to O/S≥1.0. Preferably, O/S≥1.5 or O/S≥2.0 is satisfied. By causing the O content and the S content to satisfy the above conditions, the precipitation state of the oxysulfides in the steel becomes more preferable, and the grain refinement effect can be significantly exhibited. When the average grain size of austenite of the steel plate is less than 150 μm due to the above effect, the average grain size of austenite in the HAZ can be set to 150 μm or less under standard welding conditions. The upper limit of O/S does not need to be particularly determined, but may be set to 200.0 or less, 100.0 or less, or 10.0 or less.

In the steel plate according to the present embodiment, the remainder other than the above-mentioned elements consists of Fe and impurities. In the present embodiment, the impurities are elements that are incorporated due to various factors of the manufacturing process, including raw materials such as ore and scrap, when the steel plate is industrially manufactured, and are acceptable without adversely affecting the properties of the steel plate according to the present embodiment.

$$-C+0.8\times Si-0.2\times Mn-90\times(P+S)+1.5\times(Cu+Ni+Co)+3.3\times Cr+9\times Mo+4.5\times W+0.8\times Al+6\times N+1.5\geq 3.2$$

The present inventors obtained the knowledge that the corrosion resistance of the steel plate can be improved when a CIP value expressed by $-C+0.8\times Si-0.2\times Mn-90\times(P+S)+1.5\times(Cu+Ni+Co)+3.3\times Cr+9\times Mo+4.5\times W+0.8\times Al+6\times N+1.5$ is 3.2 or more. In addition, the present inventors obtained the knowledge that the corrosion wear properties due to a material in which a slurry such as sand and gravel is mixed in salt water which is a corrosive environment can be improved by the improvement of the corrosion resistance. The upper limit of the CIP value is not particularly limited, but may be set to, for example, 65.0 or less, 50.0 or less, 40.0 or less, 30.0 or less, or 15.0 or less.

The larger the CIP value is, the more the corrosion resistance and the corrosion wear properties of the steel plate can be improved. However, in a case where the CIP value is less than 3.2, the corrosion resistance and the corrosion wear properties of the steel plate are not significantly improved.

In the above formula, C, Si, Mn, P, S, Cu, Ni, Co, Cr, Mo, W, Al, and N represent the amounts of the corresponding elements in mass %. In a case where the corresponding elements are not contained, 0 is substituted.

Volume Fraction of Austenite: 40% or More and Less Than 95%

The steel plate according to the present embodiment is an austenitic wear-resistant steel plate utilizing strain-induced martensitic transformation, and requires a predetermined amount of austenite structure. In the steel plate according to the present embodiment, the volume fraction of austenite in the steel plate is set to 40% or more and less than 95%. As necessary, the volume fraction of austenite may be set to 90% or less, 85% or less, or 80% or less. Moreover, in order to secure the wear resistance of the steel plate, the volume fraction of austenite is set to 40% or more. The volume fraction of austenite is preferably set to 45% or more, 50% or more, 55% or more, or 60% or more.

Volume Fraction of ε Martensite and α' Martensite: 5% to 60% in Total, Volume Fraction of ε Martensite: 0% to 60%, Volume Fraction of α' Martensite: 0% to 60%

The steel plate according to the present embodiment contains a predetermined amount of ε martensite and α' martensite and thus can more easily obtain desired hardness or strength, which is preferable. The total volume fraction of ε martensite and α' martensite is preferably set to 5% or more, 10% or more, or 15% or more. Moreover, in order for the steel plate to obtain ductility and toughness, the total volume fraction of ε martensite and α' martensite is preferably set to 60% or less. In addition, the total volume fraction of ε martensite and α' martensite is more preferably set to 55% or less, 50% or less, 45% or less, and 40% or less.

The metallographic structure of the steel plate according to the present embodiment is preferably made of austenite, ε martensite, and α' martensite. In addition, there may be cases where when the structure analysis is performed by X-ray diffraction, measurement results that indicate the presence of trace amounts (for example, less than 1%) of precipitates and inclusions such as iron-based carbonitrides such as cementite, carbonitrides of metal elements other than iron, and oxysulfides of Ti, Mg, Ca, REM, and the like, and other inclusions are obtained. However, these are rarely observed when observed with a typical optical microscope, or even though these are observed, these are finely dispersed in each of austenite, ε martensite, and α' martensite or at the boundaries between the structures. Therefore, these are not regarded as the metallographic structure of a so-called matrix of the steel plate.

The volume fractions of austenite, ε martensite, and α' martensite are determined by the following method.

A sample is cut out from the plate thickness center portion of the steel plate (½ T depth (T is the plate thickness) from the surface of the steel plate). A surface of the sample parallel to the plate thickness direction and the rolling direction of the sample is used as an observed section, and after the observed section is finished to a mirror surface by buffing or the like, strain is removed by electrolytic polishing or chemical polishing.

Regarding the observed section, using an X-ray diffractometer, the volume fractions of austenite, ε martensite, and α' martensite are obtained from the average value of the integrated intensities of the (311), (200), and (220) planes of austenite having a face-centered cubic structure (fcc structure), the average value of the integrated intensities of the (010), (011), and (012) planes of ε martensite having a dense hexagonal close-packed structure (hcp structure), and the average value of the integrated intensities of the (220), (200), and (211) planes of α' martensite having a body-centered cubic structure (bcc structure).

However, in a case where the C content is 0.5% or more, α' martensite has a body-centered tetragonal structure (bct structure), and the diffraction peaks obtained by X-ray diffraction measurement have double peaks due to the anisotropy of the crystal structure in some cases. In such a case, the volume fraction of a martensite is obtained from the sum of the integrated intensities of the respective peaks.

In a case where the C content is less than 0.5%, because the a/c ratio of the body-centered tetragonal lattice of α' martensite is close to 1, X-ray diffraction peaks of the body-centered cubic structure (bcc structure) and the body-centered tetragonal structure (bct structure) of α' martensite can hardly be separated from each other. Therefore, the volume fraction of α' martensite is obtained from the average value of the integrated intensities of the (220), (200), and (211) planes of the body-centered cubic structure (bcc structure). Even if the C content is less than 0.5%, in a case where the peaks can be separated from each other, the volume fraction of a martensite is obtained from the sum of the integrated intensities of the respective peaks.

Average Grain Size of Austenite: 40 to 300 μm

First, the mechanism of reducing the toughness of the high C and high Mn austenitic steel will be described. In the steel plate according to the present embodiment, since the C content and the Mn content are high, a large number of iron carbides are formed not only at austenite grain boundaries but also in the grains. Since these carbides are harder than the iron primary phase, stress concentration around the carbides is increased when an external force is applied. Accordingly, cracking occurs between the carbides or around the carbides, which causes fracture. When an external force is applied, the stress concentration that causes the steel to fracture decreases as the grain size of austenite decreases. However, excessive refinement increases the nucleation sites of carbides formed at austenite grain boundaries and has a disadvantage of increasing the amount of carbonitrides precipitated. The carbides at grain boundaries are very hard, and when the amount of the precipitated carbides increases, the toughness and ductility of the steel decrease. The present inventors found that by optimizing the grain size, the toughness and ductility of the steel plate can be improved.

In the present embodiment, the toughness of the steel plate is improved basically by refining austenite while suppressing the formation of carbides. As described above, the steel plate according to the present embodiment includes austenite in a volume fraction of 40% or more and less than 95%. Furthermore, since the steel plate according to the present embodiment is manufactured by hot rolling, as will be described later in detail, austenite in the steel plate is refined by the hot rolling, and has excellent toughness.

Since austenite grain boundaries are also nucleation sites of carbides, excessive austenite refinement promotes the formation of carbides. When carbides are excessively formed, there may be cases where the toughness of the steel plate deteriorates. From this viewpoint, the average grain size of austenite in the steel plate is set to 40 μm or more. The average grain size of austenite in the steel plate is preferably set to 50 μm or more, 75 μm or more, or 100 μm or more. On the other hand, when the average grain size of austenite exceeds 300 μm, sufficient toughness cannot be secured at a low temperature of about −40° C. Therefore, the average grain size of austenite in the steel plate is set to 300 μm or less. The average grain size of austenite in the steel plate is preferably set to 250 μm or less, or 200 μm or less. In addition, the upper and lower limits of the average grain size of the austenite are values which can be achieved by hot rolling according to the present invention, and by the austenite pinning effect by the oxysulfides and the like.

According to the steel plate according to the present embodiment, for example, even when exposed to a high temperature by welding, the average grain size of austenite in the HAZ can be reduced. For example, in a case of a steel plate having a plate thickness of 20 mm or more, even in a case where shielded metal are welding (SMAW) is performed on the steel plate with a weld heat input amount of 1.7 kJ/mm, the average grain size of austenite in a HAZ in the vicinity of a fusion line (FL) at a plate thickness center portion can be maintained in a range of 40 to 300 μm.

Furthermore, depending on the average grain size of austenite of the steel plate (base metal), as described above, by including Mg, Ca, and/or REM and furthermore causing the mass ratio of O to S in the steel plate to satisfy O/S≥1.0, the average grain size of austenite in the HAZ in the vicinity of FL after the welding can be maintained in a range of 150 μm or less, or in a range of 40 to 150 μm. As a result, the toughness of the welded joint obtained by welding the steel plate according to the present embodiment can be enhanced. Moreover, when the steel plate according to the present embodiment is welded, a highly efficient welding method such as increasing a weld heat input can be used.

Hereinafter, a method of measuring the average grain size of austenite in the present embodiment will be described. First, a sample is cut out from the plate thickness center portion of the steel plate (½ T depth (T is the plate thickness) from the surface of the steel plate). A cross section parallel to the rolling direction and the plate thickness direction of the steel plate is used as an observed section, and after the observed section is finished to a mirror surface by alumina polishing or the like, the observed section is corroded with a nital solution or picral solution. The metallographic structure of the observed section after the corrosion is enlarged and observed by an optical microscope, an electron microscope, or the like to obtain the average grain size of austenite. More specifically, in the observed section, a visual field of 1 mm×1 mm or more is enlarged at a magnification of about 100-fold, the mean lineal intercept length per austenite grain observed in the observed visual field is obtained by the linear intercept segment method in Annex C.2 of JIS G 0551: 2013, and this is used as the average grain size, whereby the average grain size of austenite is obtained.

Means for achieving the average grain size of austenite described above will be described below. Since the present embodiment relates to the steel plate, for refinement of the grain size of austenite in the steel plate (base metal), recrystallization by hot rolling can be used. The average grain size of austenite after recrystallization is expressed, for example, by Formula (1). In Formula (1), $D_{rex}$ is the average grain size of austenite after recrystallization, $D_0$ is the average grain size of austenite before recrystallization, ε is the plastic strain by hot rolling, p and q are positive constants, and r is a negative constant.

$$D_{rex}=p\times D_0^q\times\varepsilon^4 \quad (1)$$

According to Formula (1), it is possible to obtain austenite having a predetermined grain size by performing a plurality of rolling processes while making the plastic strain at the time of hot rolling as large as possible. For example, in a case where p=5, q=0.3, r=−0.75, and the initial grain size, that is, the average grain size of austenite before recrystallization is 600 μm, in order to cause the average grain size of austenite after recrystallization to be 300 μm or less, the plastic strain at the time of hot rolling needs to be 0.056 or more. Under the same conditions, in order to cause the average grain size of austenite after recrystallization to be 100 μm or less, the plastic strain at the time of hot rolling needs to be 0.25 or more. In addition, under the same conditions, in order to maintain the average grain size of austenite after recrystallization at 20 μm or more, the plastic strain at the time of hot rolling may be 2.1 or less. The plastic strain at the time of hot rolling calculated by Formula (1) for obtaining austenite having a predetermined grain size as described above is a standard, and in practice, needs to be finely adjusted in consideration of the grain growth of austenite after recrystallization and the effect of multi-pass rolling.

The present inventors confirmed that the steel plate according to the present embodiment can be manufactured by the manufacturing method described below by the research to date including the above.

(1) Melting and Slab Manufacturing Processes

Melting and slab manufacturing processes need not be particularly limited. That is, subsequent to melting by a converter, an electric furnace, or the like, various secondary refining processes are performed to achieve the above-described chemical composition. Thereafter, a slab may be manufactured by a method such as typical continuous casting.

(2) Hot Rolling Process

The slab manufactured by the above-described method is subjected to hot rolling after being heated. The slab heating temperature is preferably higher than 1250° C. to 1300° C. When the slab is heated to higher than 1300° C., there may be cases where the surface of the steel plate is oxidized and the yield decreases, and cases where austenite becomes coarse and cannot be easily refined even by hot rolling after heating the slab. Therefore, the slab heating temperature is set to 1300° C. or less. The cumulative rolling reduction in the temperature range of 900° C. to 1000° C. is set to 10% to 85%. It has been confirmed that this can enable the average grain size of austenite to be 40 to 300 μm.

However, it has been confirmed that even if the slab heating temperature is 1200° C. to 1250° C., the steel plate according to the present embodiment can be obtained by causing the cumulative rolling reduction to be 10% to lower than 30% in the temperature range of 900° C. to 1000° C. and satisfying the conditions described later.

In the present embodiment, it has been confirmed that in addition to the above conditions, it is also important to control the finish temperature during hot rolling (hereinafter, sometimes referred to as a rolling finish temperature). When the rolling finish temperature is lower than 900° C., there may be cases where austenite is not completely recrystallized and cases where austenite is excessively refined even if the austenite is recrystallized and the average grain size thereof becomes less than 40 μm. If austenite is not completely recrystallized, there may be cases where many dislocations and deformation twins are introduced into the metallographic structure, and a large amount of carbides are formed in subsequent cooling. When a large amount of carbides are formed in the steel, the ductility and toughness of the steel plate decrease. By setting the rolling finish temperature to 900° C. or higher, the above-mentioned problems can be prevented. Therefore, in the present embodiment, the rolling finish temperature is set to 900° C. or higher.

In cooling after hot rolling, accelerated cooling is performed except for a case where a heat treatment described later is performed. The purpose of the accelerated cooling is to increase the ductility and toughness of the steel plate by suppressing the formation of carbides after hot rolling. In order to suppress the formation of carbides, from the viewpoint of thermodynamics and whether diffusion is possible or not, it is necessary to set the retention time as short as possible at 850° C. to 550° C., which is a temperature range at which carbides precipitate in the steel.

The average cooling rate during accelerated cooling is set to 1° C./s or more. This is because, when the average cooling rate during accelerated cooling is less than 1° C./s, the effect of accelerated cooling (the effect of suppressing the formation of carbides) is not sufficiently obtained in some cases. On the other hand, when the cooling rate during accelerated cooling exceeds 200° C./s, there may be cases where a large amount of ε martensite and α' martensite are formed, and the toughness and ductility of the steel plate decrease. Therefore, the average cooling rate during accelerated cooling is set to 200° C./s or less.

Accelerated cooling after hot rolling starts from the high temperature side as much as possible. Since the temperature at which carbides actually start to precipitate is lower than 850° C., the cooling start temperature is set to 850° C. or higher. The cooling finishing temperature is set to 550° C. or lower. The accelerated cooling has not only the effect of suppressing the formation of carbides as described above, but also the effect of suppressing austenite grain growth. Therefore, also from the viewpoint of suppressing the austenite grain growth, the hot rolling and the accelerated cooling described above performed in combination.

(3) Heat Treatment Process

In a case where the accelerated cooling described above is not performed, for example, in a case where cooling is performed by air cooling after hot rolling, it is necessary to perform a heat treatment on the steel plate after the hot rolling in order to decompose precipitated carbides. As such a heat treatment, there is a solutionizing treatment. In the present embodiment, as the solutionizing treatment, for example, the steel plate is reheated to a temperature of 1100° C. or higher, subjected to accelerated cooling from a temperature of 1000° C. or higher at an average cooling rate of 1 to 200° C./s, and cooled to a temperature of 500° C. or lower.

The plate thickness of the steel plate according to the present embodiment need not be particularly limited, but may be set to 3 to 100 mm. As necessary, the plate thickness may be set to 6 mm or more, or 12 mm or more, and may be set to 75 mm or less, or 50 mm or less. The mechanical properties of the steel plate according to the present embodiment need not be particularly defined, but according to JIS Z 2241: 2011, the yield stress (YS) may be set to 300 N/mm$^2$ or more, the tensile strength (TS) is 1000 N/mm$^2$ or more, and the elongation (EL) may be set to 20% or more. As necessary, the tensile strength may be set to 1020 N/mm$^2$ or more, or 1050 N/mm$^2$ or more, and may be set to 2000 N/mm$^2$ or less or 1700 N/mm$^2$ or less. The toughness of the steel plate may be such that the absorbed energy at −40° C. according to JIS Z 2242: 2005 is 100 J or more or 200 J or more.

By satisfying the chemical composition and manufacturing conditions described above, an austenitic wear-resistant steel plate excellent in wear resistance and strength, and toughness and ductility can be obtained. The austenitic wear-resistant steel plate according to the present embodiment can be suitably used for small member such as a rail crossing, a caterpillar liner, an impeller blade, a crusher blade, a rock hammer, and large members that require wear resistance in the fields of construction machinery, industrial machinery, civil engineering, and architecture, such as columns, steel pipes, and outer plates.

EXAMPLES

Slabs having the chemical compositions shown in Tables 1-1 and 1-2 are hot-rolled under the rolling conditions shown in Tables 2-1 and 2-2 into steel plates having the product thicknesses shown in Tables 2-1 and 2-2. In Example 7 of Table 2-1 and Comparative Example 41 of Table 2-2, air cooling was performed after hot rolling, and a heat treatment (solutionizing treatment) was performed under the conditions shown in Tables 2-1 and 2-2. For each of test pieces collected from the obtained steel plates, the volume fractions of austenite (γ), ε martensite (ε), and α' martensite (α'), and the average grain size, yield stress (YS) tensile strength (TS), elongation (EL), wear resistance, corrosion wear properties, and toughness of austenite (γ) were evaluated. The results are shown in Tables 2-1 and 2-2.

In addition, the specific evaluation method and pass/fail criteria of each characteristic value of Tables 2-1 and 2-2 are as follows.

Volume Fractions of Austenite, ε Martensite, and α' Martensite

Three samples were cut out from the plate thickness center portion of the steel plate (½ T depth (T is the plate thickness) from the surface of the steel plate), surfaces of the samples parallel to the plate thickness direction and the rolling direction of the samples were used as observed sections, and after the observed sections were finished to mirror surfaces by buffing or the like, strain was removed by electrolytic polishing or chemical polishing.

Regarding the observed sections, using an X-ray diffractometer (XRD: RINT 2500 manufactured by Rigaku Corporation), the volume fractions of austenite, ε martensite, and α' martensite were obtained from the average value of the integrated intensities of the (311), (200), and (220) planes of austenite having a face-centered cubic structure (fcc structure), the average value of the integrated intensities of the (010), (011), and (012) planes of ε martensite having a dense hexagonal close-packed structure (hcp structure), and the average value of the integrated intensities of the (220), (200), and (211) planes of α' martensite having a body-centered cubic structure (bcc structure).

However, in a case where α' martensite had a body-centered tetragonal structure (bet structure) and the diffraction peaks obtained by X-ray diffraction measurement had double peaks due to the anisotropy of the crystal structure, the volume fraction of α' martensite was obtained from the sum of the integrated intensities of the respective peaks. In a case where the peaks could be separated from each other, the volume fraction of α' martensite was obtained from the sum of the integrated intensities of the respective peaks.

A case where the volume fraction of austenite was 40% or more and less than 95% was determined to be inside of the range of the present invention and thus passed. A case where the volume fraction of austenite was less than 40% and 95% or more was determined to be outside of the range of the present invention and thus failed.

Average Grain Size of Austenite

Three samples were cut out from the plate thickness center portion of the steel plate (½ T depth (T is the plate thickness) from the surface of the steel plate), cross sections parallel to the rolling direction and the plate thickness direction of the steel plate were used as observed sections, and after the observed sections were finished to mirror surfaces by alumina polishing or the like, the observed sections were corroded with a nital solution. In the observed sections, a visual field of 1 mm×1 mm or more was enlarged at a magnification of about 100-fold, the mean lineal intercept length per austenite grain observed in the observed visual field was obtained by the linear intercept segment method in Annex C.2 of JIS G 0551: 2013, and this was used as the average grain size.

Furthermore, under shielded metal are welding (SMAW) with a weld heat input amount of 1.7 kJ/mm, for a HAZ in the vicinity of a fusion line (FL) at the plate thickness center portion, the average grain size of austenite in the HAZ was measured.

A case where the average grain size of austenite in the steel plate (base metal) was 40 to 300 μm was determined to be within the range of the present invention and thus passed. On the other hand, a case where the average grain size of austenite in the steel plate (base metal) was out of the range of 40 to 300 μm was determined to be outside of the range of the present invention and thus failed.

Yield Stress (YS), Tensile Strength (TS), and Elongation (EL)

A tension test piece collected so that the length direction of the test piece and the width direction of the steel plate were parallel to each other was used and evaluated according to JIS Z 2241: 2011. However, the tension test piece having a plate thickness of 20 mm or less was No. 13B of JIS Z 2241: 2011, and the tension test piece having a plate thickness of more than 20 mm was No. 4 of JIS Z 2241: 2011.

A case where the yield stress (YS) was 300 $N/mm^2$ or more, the tensile strength (TS) was 1000 $N/mm^2$ or more, and the elongation (EL) was 20% or more was determined to be excellent in strength and ductility and thus passed. A case where any one of the above conditions was not satisfied was determined to be failed.

Wear Resistance

In a scratching wear test (peripheral velocity: 3.7 m/sec, 50 hours) in a case where a mixture of silica sand (No. 5 of JIS G 5901: 2016) and water (mixing ratio is silica sand 2:water 1) was used as a wear material, the wear loss was evaluated on the basis of plain steel (SS400 of JIS G 3101: 2015). The wear amount ratio to the plain steel in Tables 2-1 and 2-2 was obtained by dividing the wear loss of each steel by the wear loss of the plain steel. In a case where the plate thickness exceeded 15 mm, a test piece reduced in plate thickness to 15 mm was used.

A case where the wear amount ratio to the plain steel was less than 0.20 was determined to be excellent in wear resistance and thus passed. On the other hand, a case where the wear amount ratio to the plain steel was 0.20 or more was determined to be inferior in wear resistance and thus failed.

Corrosion Wear Properties

For evaluation of corrosion wear properties, in a scratching wear test (peripheral velocity: 3.7 m/sec, 100 hours) using a mixture of silica sand (average grain size 12 μm) and seawater (mixing ratio: 30% silica sand, 70% seawater) as a wear material, the wear loss was evaluated on the basis of plain steel (SS400 of JIS G 3101: 2015). The corrosion wear amount ratio to the plain steel in Tables 2-1 and 2-2 was obtained by dividing the corrosion wear loss of each steel by the corrosion wear loss of the plain steel. In a case where the plate thickness exceeded 15 mm, a test piece reduced in plate thickness to 15 mm was used.

In a preferable embodiment of the present invention, the target value of the corrosion wear amount ratio to the plain steel was set to 0.80 or less.

Toughness

For the toughness of the steel plate (base metal), a test piece parallel to the rolling direction was taken from the position of ¼ T (T is the plate thickness) of the steel plate, using a V-notch test piece of JIS Z 2242: 2005 in which a notch was inserted in a direction in which cracks propagate in the width direction, the absorbed energy ($vE_{-40}$° C. (J)) at −40° C. was evaluated according to JIS Z 2242: 2005.

In addition, under shielded metal are welding (SMAW) with a weld heat input amount of 1.7 kJ/mm (however, a plate thickness of 6 mm was set to 0.6 kJ/mm, and a plate thickness of 12 mm was set to 1.2 kJ/mm), using a Charpy test piece in which a HAZ in the vicinity of a fusion line (FL) at the plate thickness center portion became a notch position, the absorbed energy ($vE_{-40}$° C. (J)) at −40° C. was evaluated under the same conditions as above.

A case where the absorbed energy at −40° C. of the steel plate (base metal) was 200 J or more was determined to be excellent in toughness and thus passed. A case where the absorbed energy at −40° C. of the steel plate (base metal) was less than 200 J was determined to be inferior in toughness and thus failed.

TABLE 1-1

| | | Chemical composition (mass %) remainder including Fe and impurities | | | | | | | | | | | | | | | | |
|---|---|---|---|---|---|---|---|---|---|---|---|---|---|---|---|---|---|---|
| Classification | No. | C | Si | Mn | −13.75 × C + 16.5 | −6.5 × C + 16.5 | −20 × C + 30 | −13.75 × C + 16.5 ≤ Mn ≤ −20 × C + 30 | −6.5 × C + 16.5 ≤ Mn ≤ −20 × C + 30 | P | S | Cu | Ni | Co | Cr | Mo | W | Nb |
| Example | 1 | 0.2 | 1.80 | 20.0 | 13.8 | 15.2 | 26.0 | OK | OK | 0.005 | 0.0020 | | | | 1.0 | | | |
| Example | 2 | 0.5 | 0.60 | 18.0 | 9.6 | 13.3 | 20.0 | OK | OK | 0.005 | 0.0020 | | | | | | | |
| Example | 3 | 0.3 | 0.80 | 18.0 | 12.4 | 14.6 | 24.0 | OK | OK | 0.010 | 0.0020 | | | | | | | |
| Example | 4 | 0.3 | 0.80 | 17.0 | 12.4 | 14.6 | 24.0 | OK | OK | 0.010 | 0.0020 | | | | | | | |
| Example | 5 | 0.5 | 0.60 | 15.0 | 9.6 | 13.3 | 20.0 | OK | OK | 0.020 | 0.0020 | | | | | | | |
| Example | 6 | 0.6 | 1.00 | 16.0 | 8.3 | 12.6 | 18.0 | OK | OK | 0.001 | 0.0010 | 0.2 | | | | | | |
| Example | 7 | 1.0 | 1.00 | 5.0 | 2.8 | 10.0 | 10.0 | OK | NO | 0.001 | 0.0010 | | | 0.5 | | | | |
| Example | 8 | 1.2 | 0.80 | 6.0 | 0.0 | 8.7 | 6.0 | OK | NO | 0.002 | 0.0010 | | | | | 1.0 | 0.5 | |
| Example | 9 | 0.7 | 0.60 | 13.5 | 6.9 | 12.0 | 16.0 | OK | OK | 0.020 | 0.0020 | | | | 2.5 | | | |
| Example | 10 | 0.7 | 0.60 | 11.0 | 6.9 | 12.0 | 16.0 | OK | NO | 0.002 | 0.0001 | 0.5 | | | 4.5 | | | |
| Example | 11 | 0.7 | 0.60 | 13.5 | 6.9 | 12.0 | 16.0 | OK | OK | 0.002 | 0.0001 | | | | | | | |
| Example | 12 | 0.7 | 0.60 | 13.5 | 6.9 | 12.0 | 16.0 | OK | OK | 0.002 | 0.0001 | | | | | | | 0.03 |
| Example | 13 | 0.5 | 0.60 | 13.0 | 9.6 | 13.3 | 20.0 | OK | NO | 0.001 | 0.0020 | | | | | | | |
| Example | 14 | 0.8 | 0.60 | 13.0 | 5.5 | 11.3 | 14.0 | OK | OK | 0.001 | 0.0020 | | | | | | | |

TABLE 1-1-continued

| | | | | | | | | | | | | | | | | | |
|---|---|---|---|---|---|---|---|---|---|---|---|---|---|---|---|---|---|
| Example | 15 | 0.8 | 0.60 | 13.0 | 5.5 | 11.3 | 14.0 | OK | OK | 0.001 | 0.0020 | | | 1.0 | 0.5 | | |
| Example | 16 | 0.8 | 0.60 | 13.0 | 5.5 | 11.3 | 14.0 | OK | OK | 0.001 | 0.0020 | | | 0.7 | 0.2 | 0.2 | |
| Example | 17 | 0.8 | 0.60 | 13.0 | 5.5 | 11.3 | 14.0 | OK | OK | 0.001 | 0.0020 | | | 1.0 | 0.2 | | |
| Example | 18 | 0.8 | 0.60 | 14.0 | 5.5 | 11.3 | 14.0 | OK | OK | 0.001 | 0.0015 | | | 0.3 | 0.5 | 0.5 | |
| Example | 19 | 0.9 | 1.00 | 10.0 | 4.1 | 10.7 | 12.0 | OK | NO | 0.001 | 0.0015 | 1.0 | 1.0 | | | | |
| Example | 20 | 0.8 | 0.60 | 10.0 | 5.5 | 11.3 | 14.0 | OK | NO | 0.001 | 0.0015 | | | | | | |
| Example | 21 | 1.1 | 0.80 | 6.0 | 1.4 | 9.4 | 8.0 | OK | NO | 0.002 | 0.0010 | | 2.8 | | 0.5 | 0.5 | |
| Example | 22 | 1.1 | 0.80 | 6.0 | 1.4 | 9.4 | 8.0 | OK | NO | 0.002 | 0.0010 | | 1.0 | | 0.5 | 0.5 | |
| Example | 23 | 0.9 | 0.60 | 7.0 | 4.1 | 10.7 | 12.0 | OK | NO | 0.001 | 0.0015 | | | | | | |
| Example | 24 | 1.0 | 0.60 | 7.0 | 2.8 | 10.0 | 10.0 | OK | NO | 0.001 | 0.0015 | 3.0 | | 1.0 | | | |
| Example | 25 | 1.2 | 0.60 | 6.0 | 0.0 | 8.7 | 6.0 | OK | NO | 0.001 | 0.0020 | | | | | | |
| Example | 26 | 1.0 | 0.60 | 3.2 | 2.8 | 10.0 | 10.0 | OK | NO | 0.002 | 0.0020 | | | | | | |
| Example | 27 | 1.3 | 0.60 | 3.2 | −1.4 | 8.1 | 4.0 | OK | NO | 0.002 | 0.0015 | | | | | | |
| Example | 28 | 0.6 | 0.30 | 12.0 | 8.3 | 12.6 | 18.0 | OK | NO | 0.002 | 0.0020 | | | | | | |
| Example | 29 | 0.6 | 0.30 | 12.0 | 8.3 | 12.6 | 18.0 | OK | NO | 0.002 | 0.0022 | | | | | | |
| Example | 30 | 0.6 | 0.30 | 12.0 | 8.3 | 12.6 | 18.0 | OK | NO | 0.002 | 0.0022 | | | | | | |
| Example | 31 | 0.6 | 0.30 | 12.0 | 8.3 | 12.6 | 18.0 | OK | NO | 0.002 | 0.0010 | | | | | | |
| Example | 32 | 0.6 | 0.30 | 12.0 | 8.3 | 12.6 | 18.0 | OK | NO | 0.002 | 0.0025 | | | | | | |
| Example | 33 | 0.6 | 0.30 | 16.0 | 8.3 | 12.6 | 18.0 | OK | OK | 0.002 | 0.0010 | | | 1.0 | | | |
| Example | 34 | 0.6 | 0.30 | 16.0 | 8.3 | 12.6 | 18.0 | OK | OK | 0.002 | 0.0010 | | | 1.0 | | | |
| Example | 35 | 0.6 | 0.30 | 16.0 | 8.3 | 12.6 | 18.0 | OK | OK | 0.002 | 0.0029 | | | | | | |
| Example | 36 | 0.6 | 0.30 | 16.0 | 8.3 | 12.6 | 18.0 | OK | OK | 0.002 | 0.0012 | | | | | | |
| Example | 37 | 0.6 | 0.30 | 16.0 | 8.3 | 12.6 | 18.0 | OK | OK | 0.002 | 0.0019 | | | 1.0 | | | |
| Example | 38 | 0.9 | 0.60 | 11.0 | 4.1 | 10.7 | 12.0 | OK | OK | 0.002 | 0.0010 | | | | | | |

| | | Chemical composition (mass %) remainder including Fe and impurities | | | | | | | | | | | | | |
|---|---|---|---|---|---|---|---|---|---|---|---|---|---|---|---|
| Classification | No. | V | Ti | Zr | Ta | B | Al | N | O | Mg | Ca | REM | O/S | CIP value | CIP ≥ 3.2 |
| Example | 1 | | | | | | 0.010 | 0.003 | 0.0020 | 0.0025 | | | 1.0 | 1.4 | — |
| Example | 2 | | 0.01 | 0.02 | | | 0.003 | 0.005 | 0.0020 | 0.0025 | | | 1.0 | −2.7 | — |
| Example | 3 | | 0.03 | | | | 0.003 | 0.005 | 0.0020 | 0.0020 | 0.0020 | 0.0020 | 1.0 | −2.8 | — |
| Example | 4 | | 0.01 | | 0.03 | | 0.003 | 0.005 | 0.0020 | 0.0030 | | | 1.0 | −2.6 | — |
| Example | 5 | | | | | | 0.030 | 0.005 | 0.0020 | 0.0040 | | | 1.0 | −3.4 | — |
| Example | 6 | | 0.01 | | | | 0.010 | 0.004 | 0.0018 | 0.0030 | | | 1.8 | −1.3 | — |
| Example | 7 | | 0.01 | | | | 0.010 | 0.400 | 0.0020 | 0.0030 | | | 2.0 | 3.3 | OK |
| Example | 8 | | | | | 0.001 | 0.010 | 0.005 | 0.0020 | 0.0060 | | | 2.0 | 10.8 | OK |
| Example | 9 | | 0.01 | | | | 0.005 | 0.005 | 0.0020 | 0.0040 | | | 1.0 | 4.9 | OK |
| Example | 10 | | 0.01 | | | | 0.005 | 0.005 | 0.0015 | 0.0030 | | | 15.0 | 14.5 | OK |
| Example | 11 | | 0.01 | | | | 0.005 | 0.020 | 0.0070 | 0.0022 | | | 70.0 | −1.5 | — |
| Example | 12 | | 0.01 | | | | 0.005 | 0.005 | 0.0020 | 0.0030 | | | 20.0 | −1.6 | — |
| Example | 13 | | | | | | 0.007 | 0.110 | 0.0020 | 0.0030 | | | 1.0 | −0.7 | — |
| Example | 14 | | 0.01 | | | | 0.007 | 0.005 | 0.0020 | 0.0030 | | | 1.0 | −1.7 | — |
| Example | 15 | | 0.01 | | | | 0.007 | 0.003 | 0.0020 | 0.0030 | | | 1.0 | 6.1 | OK |
| Example | 16 | | 0.01 | | | | 0.007 | 0.003 | 0.0020 | | | | 1.0 | 3.3 | OK |
| Example | 17 | | 0.01 | | | | 0.007 | 0.003 | 0.0020 | | | | 1.0 | 3.4 | OK |
| Example | 18 | 0.10 | 0.01 | | | | 0.007 | 0.003 | 0.0015 | | | | 1.0 | 5.9 | OK |
| Example | 19 | | 0.01 | | | | 0.030 | 0.003 | | | | | 0.0 | 2.2 | — |
| Example | 20 | | | | | | 0.003 | 0.002 | 0.0020 | | 0.0030 | | 1.3 | −1.0 | — |
| Example | 21 | | 0.01 | | | 0.001 | 0.005 | 0.005 | 0.0020 | 0.0050 | | | 2.0 | 10.6 | OK |
| Example | 22 | | 0.01 | | | 0.300 | 0.010 | 0.005 | 0.0020 | 0.0050 | | | 2.0 | 7.9 | OK |
| Example | 23 | | 0.01 | | | | 0.002 | 0.050 | 0.0020 | | | 0.0030 | 1.3 | −0.2 | — |
| Example | 24 | | | | | | 0.005 | 0.005 | 0.0020 | | | 0.0030 | 1.3 | 5.4 | OK |
| Example | 25 | | 0.01 | | | | 0.005 | 0.005 | 0.0020 | 0.0022 | | | 1.0 | −0.7 | — |
| Example | 26 | | 0.01 | | | | 0.003 | 0.005 | 0.0022 | 0.0030 | | | 1.1 | 0.0 | — |
| Example | 27 | | 0.01 | | | | 0.018 | 0.005 | 0.0017 | 0.0030 | | | 1.1 | −0.2 | — |
| Example | 28 | | | | | | 0.002 | 0.002 | | | | | 0.0 | −1.6 | — |
| Example | 29 | | | | | | 0.300 | 0.002 | 0.0007 | 0.0030 | | | 0.3 | −1.4 | — |
| Example | 30 | | 0.01 | | | | 0.010 | 0.010 | | | | | 0.0 | −1.6 | — |
| Example | 31 | | 0.01 | | | | 0.030 | 0.002 | | | | | 0.0 | −1.5 | — |
| Example | 32 | | | | | | 0.050 | 0.002 | 0.0010 | 0.0030 | | | 0.4 | −1.6 | — |
| Example | 33 | | 0.01 | | | | 0.020 | 0.005 | 0.0012 | | | | 1.2 | 1.0 | — |
| Example | 34 | | 0.01 | | | | 0.020 | 0.005 | 0.0012 | | | | 1.2 | 1.0 | — |
| Example | 35 | | 0.01 | | | | 0.030 | 0.005 | 0.0015 | 0.0030 | | | 0.5 | −2.4 | — |
| Example | 36 | | 0.02 | | | | 0.010 | 0.003 | | | | | 0.0 | −2.3 | — |
| Example | 37 | | | | | | 0.050 | 0.002 | | | | | 0.0 | 0.9 | — |
| Example | 38 | | 0.02 | | | | 0.001 | 0.005 | 0.0100 | 0.0030 | | | 10.0 | −1.4 | — |

Blank means that the element is not intentionally contained.

TABLE 1-2

| Classification | No. | Chemical composition (mass %) remainder including Fe and impurities | | | | | | | | | | | | | | | | |
|---|---|---|---|---|---|---|---|---|---|---|---|---|---|---|---|---|---|---|
| | | C | Si | Mn | −13.75 × C + 16.5 | −6.5 × C + 16.5 | −20 × C + 30 | −13.75 × C + 16.5 ≤ Mn ≤ −20 × C + 30 | −6.5 × C + 16.5 ≤ Mn ≤−20 × C + 30 | P | S | Cu | Ni | Co | Cr | Mo | W | Nb |
| Comparative Example | 39 | 0.5 | 0.60 | 24.9 | 9.6 | 13.3 | 20.0 | NO | NO | 0.005 | 0.0020 | | | | 1.0 | | | |
| Comparative Example | 40 | 0.8 | 0.60 | 18.0 | 5.5 | 11.3 | 14.0 | NO | NO | 0.005 | 0.0020 | | | | | | | |
| Comparative Example | 41 | 1.4 | 0.10 | 5.0 | −2.8 | 7.4 | 2.0 | NO | NO | 0.001 | 0.0010 | | | 0.5 | | | | |
| Comparative Example | 42 | 1.0 | 0.60 | 14.0 | 2.8 | 10.0 | 10.0 | NO | NO | 0.020 | 0.0020 | | | | | 0.5 | 1.0 | |
| Comparative Example | 43 | 1.0 | 0.60 | 20.0 | 2.8 | 10.0 | 10.0 | NO | NO | 0.001 | 0.0030 | | | | | | | |
| Comparative Example | 44 | 1.2 | 0.60 | 15.0 | 0.0 | 8.7 | 6.0 | NO | NO | 0.001 | 0.0020 | | | | | | | |
| Comparative Example | 45 | 0.25 | 0.60 | 3.0 | 13.1 | 14.9 | 25.0 | NO | NO | 0.001 | 0.0015 | | | | | | | |
| Comparative Example | 46 | 0.3 | 0.60 | 10.0 | 12.4 | 14.6 | 24.0 | NO | NO | 0.001 | 0.0010 | | | | | | | |
| Comparative Example | 47 | 0.5 | 0.60 | 7.0 | 9.6 | 13.3 | 20.0 | NO | NO | 0.001 | 0.0015 | | | | | | | |
| Comparative Example | 48 | 0.8 | 0.60 | 3.0 | 5.5 | 11.3 | 14.0 | NO | NO | 0.001 | 0.0030 | | | | | | | |
| Comparative Example | 49 | 0.1 | 0.60 | 20.0 | 15.1 | 15.9 | 28.0 | OK | OK | 0.001 | 0.0010 | | | | | | | |
| Comparative Example | 50 | 1.8 | 0.60 | 3.5 | −8.3 | 4.8 | −6.0 | NO | NO | 0.001 | 0.0025 | | | | | | | |
| Comparative Example | 51 | 1.2 | 0.60 | 0.5 | 0.0 | 8.7 | 6.0 | OK | NO | 0.001 | 0.0015 | | | | | | | |
| Comparative Example | 52 | 0.3 | 0.80 | 14.0 | 12.4 | 14.6 | 24.0 | OK | NO | 0.010 | 0.0020 | | | | | | | |
| Comparative Example | 53 | 0.5 | 0.60 | 15.0 | 9.6 | 13.3 | 20.0 | OK | OK | 0.020 | 0.0020 | | | | | | | |
| Comparative Example | 54 | 0.5 | 0.60 | 15.0 | 9.6 | 13.3 | 20.0 | OK | OK | 0.020 | 0.0020 | | | | | | | |
| Comparative Example | 55 | 0.75 | 0.60 | 15.0 | 6.2 | 11.6 | 15.0 | OK | OK | 0.002 | 0.0010 | | | | | | | |
| Comparative Example | 56 | 0.9 | 0.60 | 12.0 | 4.1 | 10.7 | 12.0 | OK | OK | 0.002 | 0.0010 | | | | | | | |
| Comparative Example | 57 | 0.9 | 0.60 | 12.0 | 4.1 | 10.7 | 12.0 | OK | OK | 0.002 | 0.0200 | | | | | | | |
| Comparative Example | 58 | 0.9 | 0.60 | 12.0 | 4.1 | 10.7 | 12.0 | OK | OK | 0.060 | 0.0010 | | | | | | | |

| Classification | No. | Chemical composition (mass %) remainder including Fe and impurities | | | | | | | | | | | | | |
|---|---|---|---|---|---|---|---|---|---|---|---|---|---|---|---|
| | | V | Ti | Zr | Ta | B | Al | N | O | Mg | Ca | REM | O/S | CIP value | CIP ≥ 3.2 |
| Comparative Example | 39 | | 0.01 | | | | 0.010 | 0.002 | 0.0025 | 0.0025 | | | 1.3 | −0.8 | — |
| Comparative Example | 40 | 0.05 | 0.01 | | | | 0.003 | 0.005 | 0.0020 | 0.0025 | | | 1.0 | −3.0 | — |

TABLE 1-2-continued

| | | | | | | | | | | | | | | | |
|---|---|---|---|---|---|---|---|---|---|---|---|---|---|---|---|
| Comparative Example | 41 | | 0.03 | | | 0.010 | 0.005 | 0.0020 | 0.0030 | | | 2.0 | −0.2 | — |
| Comparative Example | 42 | 0.01 | | | | 0.003 | 0.005 | 0.0020 | 0.0040 | | | 1.0 | 5.2 | OK |
| Comparative Example | 43 | 0.01 | | | | 0.005 | 0.005 | 0.0020 | 0.0050 | | | 0.7 | −3.3 | — |
| Comparative Example | 44 | 0.01 | | | | 0.010 | 0.005 | 0.0019 | 0.0050 | | | 1.0 | −2.5 | — |
| Comparative Example | 45 | 0.01 | | | 0.001 | 0.010 | 0.005 | 0.0018 | 0.0050 | | | 1.2 | 0.9 | — |
| Comparative Example | 46 | 0.01 | | | | 0.003 | 0.005 | 0.0022 | 0.0050 | | | 2.2 | −0.5 | — |
| Comparative Example | 47 | 0.01 | | | | 0.010 | 0.005 | 0.0018 | 0.0050 | | | 1.2 | −0.1 | — |
| Comparative Example | 48 | 0.01 | | | | 0.010 | 0.005 | 0.0018 | 0.0020 | | 0.0008 | 0.6 | 0.3 | — |
| Comparative Example | 49 | 0.01 | | | | 0.010 | 0.005 | 0.0018 | 0.0050 | | | 1.8 | −2.3 | — |
| Comparative Example | 50 | | | | | 0.030 | 0.005 | 0.0015 | 0.0050 | | | 0.6 | −0.8 | — |
| Comparative Example | 51 | | | | | 0.010 | 0.005 | 0.0018 | 0.0050 | 0.0010 | | 1.2 | 0.5 | — |
| Comparative Example | 52 | | | | | 0.010 | 0.002 | | | | | 0.0 | −2.0 | — |
| Comparative Example | 53 | 0.01 | | | | 0.010 | 0.005 | 0.0020 | 0.0040 | | | 1.0 | −3.5 | — |
| Comparative Example | 54 | 0.01 | | | | 0.010 | 0.005 | 0.0020 | 0.0040 | | | 1.0 | −3.5 | — |
| Comparative Example | 55 | 0.01 | | | | 0.010 | 0.005 | 0.0020 | 0.0200 | | | 2.0 | −2.0 | — |
| Comparative Example | 56 | 0.35 | | | | 0.001 | 0.005 | 0.0020 | 0.0030 | | | 2.0 | −1.6 | — |
| Comparative Example | 57 | 0.01 | | | | 0.007 | 0.005 | 0.0020 | 0.0030 | | | 0.1 | −3.3 | — |
| Comparative Example | 58 | 0.01 | | | | 0.005 | 0.005 | 0.0020 | 0.0030 | | | 2.0 | −6.8 | — |

Blank means that the element is not intentionally contained.
Underlined means outside of the range of the present invention.

TABLE 2-1

| | | Rolling conditions | | | | | | | | | Heat treatment conditions | | | |
|---|---|---|---|---|---|---|---|---|---|---|---|---|---|---|
| | | | | | | | Cumulative | | | | | | | |
| Classification | No. | Slab thickness (mm) | Product thickness (mm) | Heating temperature (° C.) | Rolling start temperature (° C.) | Rolling finish temperature (° C.) | rolling reduction at 900° C. to 1000° C. (%) | Cooling start temperature (° C.) | Cooling rate (° C./s) | Cooling finish temperature (° C.) | Reheating temperature (° C.) | Cooling start temperature (° C.) | Cooling rate (° C./s) | Cooling finish temperature (° C.) |
| Example | 1 | 250 | 12 | 1260 | 1100 | 900 | 83 | 870 | 63 | 480 | | | | |
| Example | 2 | 250 | 25 | 1260 | 1100 | 1000 | 68 | 970 | 30 | 400 | | | | |
| Example | 3 | 250 | 25 | 1260 | 1100 | 1000 | 68 | 970 | 30 | 250 | | | | |
| Example | 4 | 250 | 35 | 1275 | 1097 | 1045 | 50 | 1030 | 21 | 80 | | | | |
| Example | 5 | 250 | 35 | 1275 | 1097 | 1045 | 50 | 1030 | 21 | 90 | | | | |
| Example | 6 | 250 | 35 | 1275 | 1100 | 1000 | 50 | 1030 | 21 | 20 | | | | |
| Example | 7 | 250 | 35 | 1275 | 1100 | 1000 | 65 | — | — | — | 1250 | 1200 | 21 | 100 |
| Example | 8 | 250 | 35 | 1275 | 1100 | 1000 | 65 | 990 | 21 | 500 | | | | |

TABLE 2-1-continued

| | | | | | | | | | | |
|---|---|---|---|---|---|---|---|---|---|---|
| Example | 9 | 250 | 35 | 1275 | 1100 | 900 | 75 | 890 | 21 | 510 |
| Example | 10 | 250 | 35 | 1275 | 1100 | 900 | 75 | 890 | 21 | 80 |
| Example | 11 | 250 | 35 | 1300 | 1150 | 950 | 54 | 940 | 21 | 80 |
| Example | 12 | 250 | 35 | 1260 | 1150 | 950 | 54 | 940 | 21 | 90 |
| Example | 13 | 250 | 50 | 1260 | 1140 | 900 | 58 | 890 | 15 | 350 |
| Example | 14 | 250 | 50 | 1260 | 1140 | 900 | 58 | 880 | 15 | 360 |
| Example | 15 | 250 | 50 | 1260 | 1140 | 900 | 58 | 890 | 15 | 350 |
| Example | 16 | 250 | 50 | 1200 | 1150 | 1030 | 25 | 1020 | 15 | 340 |
| Example | 17 | 250 | 50 | 1200 | 1150 | 1030 | 28 | 1010 | 15 | 360 |
| Example | 18 | 250 | 50 | 1200 | 1150 | 1030 | 25 | 1024 | 15 | 350 |
| Example | 19 | 250 | 6 | 1275 | 1100 | 900 | 85 | 850 | 125 | 450 |
| Example | 20 | 250 | 20 | 1260 | 1130 | 1005 | 52 | 990 | 38 | 90 |
| Example | 21 | 250 | 20 | 1260 | 1130 | 1005 | 52 | 980 | 38 | 90 |
| Example | 22 | 250 | 20 | 1260 | 1130 | 1005 | 52 | 990 | 38 | 80 |
| Example | 23 | 250 | 35 | 1260 | 1090 | 1020 | 68 | 1010 | 21 | 300 |
| Example | 24 | 250 | 35 | 1260 | 1090 | 1020 | 68 | 1000 | 21 | 310 |
| Example | 25 | 250 | 35 | 1260 | 1090 | 1020 | 68 | 1000 | 21 | 290 |
| Example | 26 | 250 | 12 | 1275 | 1130 | 950 | 66 | 930 | 63 | 250 |
| Example | 27 | 250 | 12 | 1275 | 1130 | 950 | 66 | 920 | 63 | 260 |
| Example | 28 | 250 | 12 | 1275 | 1120 | 1050 | 34 | 1020 | 63 | 240 |
| Example | 29 | 250 | 12 | 1275 | 1120 | 1050 | 34 | 1020 | 63 | 250 |
| Example | 30 | 250 | 12 | 1260 | 1090 | 1050 | 60 | 1010 | 63 | 250 |
| Example | 31 | 250 | 12 | 1260 | 1150 | 940 | 61 | 920 | 63 | 240 |
| Example | 32 | 250 | 12 | 1260 | 1150 | 940 | 61 | 910 | 63 | 260 |
| Example | 33 | 250 | 12 | 1260 | 1150 | 1000 | 48 | 910 | 63 | 250 |
| Example | 34 | 250 | 12 | 1260 | 1150 | 940 | 61 | 920 | 63 | 230 |
| Example | 35 | 250 | 12 | 1260 | 1100 | 1025 | 63 | 1000 | 63 | 260 |
| Example | 36 | 250 | 12 | 1260 | 1120 | 1050 | 34 | 1020 | 63 | 240 |
| Example | 37 | 250 | 12 | 1260 | 1100 | 900 | 83 | 870 | 63 | 250 |
| Example | 38 | 250 | 35 | 1260 | 1080 | 1009 | 80 | 1000 | 21 | 250 |

| | | Metallographic structure state | | | | | | Mechanical properties | | | | | | |
|---|---|---|---|---|---|---|---|---|---|---|---|---|---|---|
| | | Base metal | | | | | HAZ | Base metal | | | | | | |
| | | | | | | | | | | | corrosion | | | |
| Classification | No. | γ volume fraction (%) | ε + α' volume fraction (%) | ε volume fraction (%) | α' volume fraction (%) | γ average grain size (μm) | γ average grain size (μm) | YS (N/mm$^2$) | TS (N/mm$^2$) | EL (%) | Wear amount ratio to plain steel | wear amount ratio to plain steel | $vE_{-40° C.}$ (J) | HAZ $vE_{-40° C.}$ (J) |
| Example | 1 | 67 | 33 | 33 | 0 | 47 | 118 | 320 | 1005 | 45 | 0.17 | 0.90 | 313 | 240 |
| Example | 2 | 80 | 20 | 20 | 0 | 67 | 110 | 336 | 1063 | 52 | 0.13 | 1.15 | 340 | 273 |
| Example | 3 | 60 | 40 | 40 | 0 | 67 | 72 | 305 | 1088 | 42 | 0.16 | 1.16 | 304 | 243 |
| Example | 4 | 54 | 46 | 46 | 0 | 100 | 104 | 304 | 1119 | 40 | 0.14 | 1.15 | 320 | 212 |
| Example | 5 | 63 | 37 | 37 | 0 | 100 | 102 | 318 | 1228 | 43 | <0.01 | 1.20 | 326 | 240 |
| Example | 6 | 80 | 20 | 20 | 0 | 99 | 102 | 337 | 1089 | 52 | 0.11 | 1.07 | 353 | 276 |
| Example | 7 | 86 | 14 | 8 | 6 | 73 | 102 | 538 | 1386 | 45 | <0.01 | 0.78 | 287 | 286 |
| Example | 8 | 92 | 8 | 3 | 5 | 73 | 81 | 528 | 1187 | 49 | <0.01 | 0.32 | 304 | 293 |
| Example | 9 | 91 | 9 | 9 | 0 | 58 | 93 | 427 | 1064 | 60 | <0.01 | 0.68 | 291 | 315 |
| Example | 10 | 91 | 9 | 9 | 0 | 58 | 104 | 466 | 1088 | 50 | <0.01 | 0.09 | 288 | 294 |
| Example | 11 | 77 | 23 | 23 | 0 | 93 | 114 | 360 | 1193 | 48 | <0.01 | 1.08 | 323 | 302 |
| Example | 12 | 76 | 24 | 24 | 0 | 89 | 104 | 366 | 1206 | 47 | <0.01 | 1.08 | 305 | 300 |
| Example | 13 | 59 | 41 | 2 | 39 | 81 | 110 | 577 | 1534 | 39 | <0.01 | 1.03 | 234 | 220 |
| Example | 14 | 84 | 16 | 16 | 0 | 81 | 104 | 380 | 1135 | 50 | <0.01 | 1.09 | 337 | 307 |
| Example | 15 | 92 | 8 | 8 | 0 | 81 | 104 | 413 | 1051 | 52 | <0.01 | 0.61 | 359 | 329 |
| Example | 16 | 89 | 11 | 11 | 0 | 166 | 185 | 375 | 1060 | 52 | <0.01 | 0.78 | 255 | 190 |
| Example | 17 | 91 | 9 | 9 | 0 | 150 | 185 | 382 | 1047 | 52 | <0.01 | 0.77 | 274 | 194 |
| Example | 18 | 94 | 6 | 6 | 0 | 146 | 190 | 394 | 1007 | 53 | 0.08 | 0.62 | 289 | 203 |
| Example | 19 | 86 | 14 | 0 | 14 | 46 | 177 | 529 | 1256 | 46 | <0.01 | 0.85 | 283 | 105 |
| Example | 20 | 65 | 35 | 9 | 26 | 93 | 110 | 556 | 1508 | 40 | <0.01 | 1.05 | 249 | 210 |
| Example | 21 | 94 | 6 | 2 | 4 | 93 | 105 | 481 | 1125 | 53 | <0.01 | 0.33 | 295 | 315 |
| Example | 22 | 84 | 16 | 6 | 10 | 93 | 105 | 519 | 1272 | 47 | <0.01 | 0.50 | 285 | 285 |
| Example | 23 | 61 | 39 | 21 | 18 | 67 | 104 | 549 | 1571 | 36 | <0.01 | 1.00 | 256 | 239 |
| Example | 24 | 75 | 25 | 10 | 15 | 67 | 110 | 533 | 1388 | 42 | <0.01 | 0.65 | 265 | 268 |
| Example | 25 | 87 | 13 | 5 | 8 | 67 | 114 | 516 | 1238 | 45 | <0.01 | 1.03 | 296 | 295 |
| Example | 26 | 42 | 58 | 45 | 13 | 71 | 104 | 520 | 1761 | 25 | <0.01 | 0.99 | 221 | 201 |
| Example | 27 | 82 | 18 | 10 | 8 | 71 | 104 | 536 | 1331 | 42 | <0.01 | 1.00 | 271 | 223 |
| Example | 28 | 55 | 45 | 7 | 38 | 145 | 252 | 594 | 1666 | 36 | <0.01 | 1.09 | 221 | 111 |
| Example | 29 | 52 | 48 | 10 | 38 | 145 | 190 | 602 | 1706 | 34 | <0.01 | 1.07 | 249 | 155 |
| Example | 30 | 56 | 44 | 7 | 37 | 81 | 177 | 624 | 1671 | 35 | <0.01 | 1.08 | 295 | 120 |
| Example | 31 | 55 | 45 | 7 | 38 | 78 | 222 | 629 | 1684 | 34 | <0.01 | 1.08 | 269 | 138 |
| Example | 32 | 55 | 45 | 7 | 38 | 78 | 135 | 628 | 1686 | 35 | <0.01 | 1.09 | 269 | 143 |
| Example | 33 | 85 | 15 | 15 | 0 | 104 | 185 | 355 | 1062 | 52 | 0.11 | 0.92 | 317 | 213 |
| Example | 34 | 85 | 15 | 15 | 0 | 78 | 185 | 367 | 1073 | 51 | 0.11 | 0.92 | 344 | 215 |
| Example | 35 | 79 | 21 | 21 | 0 | 75 | 144 | 349 | 1138 | 49 | 0.11 | 1.14 | 321 | 206 |

TABLE 2-1-continued

| | | | | | | | | | | | | | | |
|---|---|---|---|---|---|---|---|---|---|---|---|---|---|---|
| Example | 36 | 79 | 21 | 21 | 0 | 145 | 163 | 324 | 1114 | 50 | 0.13 | 1.13 | 298 | 207 |
| Example | 37 | 85 | 15 | 15 | 0 | 49 | 242 | 388 | 1098 | 49 | 0.10 | 0.93 | 342 | 145 |
| Example | 38 | 83 | 17 | 17 | 0 | 51 | 101 | 421 | 1190 | 48 | <0.01 | 1.07 | 333 | 308 |

TABLE 2-2

| | | Rolling conditions | | | | | | | | | Heat treatment conditions | | | |
|---|---|---|---|---|---|---|---|---|---|---|---|---|---|---|
| | | | | | | | Cumulative | | | | | | | |
| Classification | No | Slab thickness (mm) | Product thickness (mm) | Heating temperature (° C.) | Rolling start temperature (° C.) | Rolling finish temperature (° C.) | rolling reduction at 900° C. to 1000° C. (%) | Cooling start temperature (° C.) | Cooling rate (° C./s) | Cooling finish temperature (° C.) | Reheating temperature (° C.) | Cooling start temperature (° C.) | Cooling rate (° C./s) | Cooling finish temperature (° C.) |
| Comparative Example | 39 | 250 | 12 | 1260 | 1120 | 900 | 76 | 870 | 63 | 70 | | | | |
| Comparative Example | 40 | 250 | 25 | 1260 | 1100 | 1000 | 68 | 980 | 30 | 400 | | | | |
| Comparative Example | 41 | 250 | 35 | 1260 | 1100 | 1000 | 65 | — | — | — | 950 | 900 | 21 | 100 |
| Comparative Example | 42 | 250 | 35 | 1260 | 1150 | 960 | 52 | 950 | 21 | 90 | | | | |
| Comparative Example | 43 | 250 | 25 | 1260 | 1100 | 1000 | 68 | 980 | 30 | 80 | | | | |
| Comparative Example | 44 | 250 | 25 | 1260 | 1100 | 1000 | 68 | 980 | 30 | 90 | | | | |
| Comparative Example | 45 | 250 | 25 | 1275 | 1120 | 1020 | 50 | 1000 | 30 | 80 | | | | |
| Comparative Example | 46 | 250 | 25 | 1275 | 1120 | 1020 | 50 | 990 | 30 | 80 | | | | |
| Comparative Example | 47 | 250 | 25 | 1275 | 1120 | 1020 | 50 | 990 | 30 | 90 | | | | |
| Comparative Example | 48 | 250 | 25 | 1275 | 1120 | 1020 | 50 | 1000 | 30 | 90 | | | | |
| Comparative Example | 49 | 250 | 25 | 1275 | 1120 | 1020 | 50 | 990 | 30 | 80 | | | | |
| Comparative Example | 50 | 250 | 25 | 1275 | 1120 | 1020 | 50 | 1000 | 30 | 90 | | | | |
| Comparative Example | 51 | 250 | 25 | 1275 | 1120 | 1020 | 50 | 990 | 30 | 90 | | | | |
| Comparative Example | 52 | 250 | 35 | 1350 | 1170 | 1065 | 10 | 1040 | 21 | 80 | | | | |
| Comparative Example | 53 | 250 | 12 | 1050 | 990 | 950 | 95 | 920 | 63 | 90 | | | | |
| Comparative Example | 54 | 250 | 6 | 1000 | 950 | 900 | 98 | 850 | 125 | 70 | | | | |
| Comparative Example | 55 | 250 | 35 | 1260 | 1050 | 980 | 86 | 970 | 21 | 250 | | | | |
| Comparative Example | 56 | 250 | 35 | 1260 | 1050 | 980 | 86 | 960 | 21 | 240 | | | | |
| Comparative Example | 57 | 250 | 35 | 1260 | 1050 | 980 | 86 | 960 | 21 | 260 | | | | |
| Comparative Example | 58 | 250 | 35 | 1260 | 1050 | 980 | 86 | 970 | 21 | 250 | | | | |

| | | Metallographic structure state | | | | | | Mechanical properties | | | | | | |
|---|---|---|---|---|---|---|---|---|---|---|---|---|---|---|
| | | | | | | | | Base metal | | | | | | |
| | | Base metal | | | | | HAZ | | | | corrosion | | | |
| Classification | No | γ volume fraction (%) | ε + α' volume fraction (%) | γ volume fraction (%) | α' volume fraction (%) | γ average grain size (μm) | γ average grain size (μm) | YS (N/mm$^2$) | TS (N/mm$^2$) | EL (%) | Wear amount ratio to plain steel | wear amount ratio to plain steel | $vE_{-40°\ C.}$ (J) | HAZ $vE_{-40°\ C.}$ (J) |
| Comparative Example | 39 | 100 | 0 | 0 | 0 | 58 | 131 | 363 | 877 | 61 | 0.12 | 1.04 | 382 | 307 |
| Comparative Example | 40 | 100 | 0 | 0 | 0 | 69 | 130 | 393 | 909 | 58 | 0.07 | 1.17 | 367 | 285 |
| Comparative Example | 41 | 100 | 0 | 0 | 0 | 73 | 130 | 488 | 984 | 49 | 0.01 | 1.00 | 354 | 262 |
| Comparative Example | 42 | 100 | 0 | 0 | 0 | 95 | 113 | 433 | 904 | 65 | 0.05 | 0.66 | 361 | 309 |

TABLE 2-2-continued

| | | | | | | | | | | | | | | |
|---|---|---|---|---|---|---|---|---|---|---|---|---|---|---|
| Comparative Example | 43 | 100 | 0 | 0 | 0 | 69 | 104 | 423 | 908 | 55 | 0.05 | 1.19 | 363 | 207 |
| Comparative Example | 44 | 100 | 0 | 0 | 0 | 69 | 105 | 458 | 955 | 52 | 0.03 | 1.14 | 354 | 254 |
| Comparative Example | 45 | 0 | 100 | 0 | 100 | 101 | 155 | 613 | 1633 | 6 | 0.34 | 0.93 | 43 | 28 |
| Comparative Example | 46 | 7 | 93 | 85 | 8 | 101 | 155 | 319 | 1514 | 12 | 0.16 | 1.01 | 81 | 65 |
| Comparative Example | 47 | 8 | 92 | 86 | 6 | 101 | 154 | 354 | 1837 | 10 | 0.08 | 0.99 | 61 | 44 |
| Comparative Example | 48 | 13 | 87 | 81 | 6 | 101 | 177 | 415 | 1998 | 11 | <0.01 | 0.97 | 72 | 6 |
| Comparative Example | 49 | 52 | 48 | 48 | 0 | 101 | 155 | 249 | 796 | 40 | 0.24 | 1.13 | 256 | 195 |
| Comparative Example | 50 | 100 | 0 | 0 | 0 | 101 | 159 | 545 | 1145 | 17 | <0.01 | 1.03 | 78 | 5 |
| Comparative Example | 51 | 47 | 53 | 42 | 11 | 101 | 151 | 520 | 1702 | 16 | <0.01 | 0.96 | 72 | 34 |
| Comparative Example | 52 | 35 | 65 | 13 | 52 | 460 | 702 | 454 | 1464 | 24 | 0.10 | 1.11 | 30 | 5 |
| Comparative Example | 53 | 63 | 37 | 37 | 0 | 31 | 113 | 411 | 1296 | 43 | 0.09 | 1.20 | 123 | 180 |
| Comparative Example | 54 | 63 | 37 | 37 | 0 | 16 | 113 | 435 | 1315 | 42 | 0.07 | 1.20 | 86 | 178 |
| Comparative Example | 55 | 90 | 10 | 10 | 0 | 44 | 95 | 402 | 1082 | 19 | 0.07 | 1.11 | 20 | 27 |
| Comparative Example | 56 | 89 | 11 | 11 | 0 | 44 | 70 | 481 | 1177 | 8 | 0.02 | 1.08 | 34 | 16 |
| Comparative Example | 57 | 89 | 11 | 11 | 0 | 44 | 122 | 429 | 1130 | 19 | 0.05 | 1.19 | 36 | 31 |
| Comparative Example | 58 | 89 | 11 | 11 | 0 | 44 | 122 | 429 | 1132 | 17 | 0.05 | 1.40 | 36 | 30 |

Underlined means outside of the range of the present invention or outside of a preferable range.

What is claimed is:

1. An austenitic wear-resistant steel plate comprising, as a chemical composition, by mass %:

C: 0.2% to 1.6%;
Si: 0.01% to 2.00%;
Mn: 2.5% to 30.0%;
P: 0.050% or less;
S: 0.0100% or less;
Cu: 0% to 3.0%;
Ni: 0% to 3.0%;
Co: 0% to 3.0%;
Cr: 0% to 5.0%;
Mo: 0% to 2.0%;
W: 0% to 2.0%;
Nb: 0% to 0.30%;
V: 0% to 0.30%;
Ti: 0% to 0.30%;
Zr: 0% to 0.30%;
Ta: 0% to 0.30%;
B: 0% to 0.300%;
Al: 0.001% to 0.300%;
N: 0% to 1.000%;
O: 0% to 0.0100%;
Mg: 0% to 0.0100%;
Ca: 0% to 0.0100%;
REM: 0% to 0.0100%; and
a remainder including Fe and impurities, wherein, when amounts of C and Mn by mass % are respectively referred to as C and Mn, the amounts of C and Mn satisfy $-13.75\times C+16.5\leq Mn\leq -20\times C+30$, a metallographic structure includes, by volume fraction, austenite: 40% or more and less than 95%, ε martensite: 0% to 60% and α' martensite: 0% to 60%, and a sum of the ε martensite and the α' martensite is 5% to 60%, and an average grain size of the austenite is 40 to 300 μm.

2. The austenitic wear-resistant steel plate according to claim 1, wherein the chemical composition satisfies the following formula, $$-C+0.8\times Si-0.2\times Mn-90\times(P+S)+1.5\times(Cu+Ni+Co)+3.3\times Cr+9\times Mo+4.5\times W+0.8\ Al+6\times N+1.5\geq 3.2$$

where a symbol for each of elements in the formula represents an amount of the corresponding element by mass %.

3. The austenitic wear-resistant steel plate according to claim 1, wherein, the chemical composition includes, by mass %, 0.0001% to 0.0100% of O, and a sum of a Mg content, a Ca content, and a REM content is 0.0001% to 0.0100%.

4. The austenitic wear-resistant steel plate according to claim 3, wherein, the chemical composition includes, by mass %, 0.0001% to 0.0050% of S, and amounts of O and S by mass % satisfy $O/S\geq 1.0$.

5. The austenitic wear-resistant steel plate according to claim 1, wherein, as the chemical composition, when the amounts of C and Mn by mass % are respectively referred to as C and Mn, the amounts of C and Mn satisfy $-6.5\times C+16.5\leq Mn\leq -20\times C+30$.

6. The austenitic wear-resistant steel plate according to claim 2, wherein, the chemical composition includes, by mass %, 0.0001% to 0.0100% of O, and a sum of a Mg content, a Ca content, and a REM content is 0.0001% to 0.0100%.

7. The austenitic wear-resistant steel plate according to claim 6, wherein, the chemical composition includes, by mass %, 0.0001% to 0.0050% of S, and amounts of O and S by mass % satisfy $O/S \geq 1.0$.

8. The austenitic wear-resistant steel plate according to claim 2, wherein, as the chemical composition, when the amounts of C and Mn by mass % are respectively referred to as C and Mn, the amounts of C and Mn satisfy $-6.5 \times C + 16.5 \leq Mn \leq -20 \times C + 30$.

9. The austenitic wear-resistant steel plate according to claim 3, wherein, as the chemical composition, when the amounts of C and Mn by mass % are respectively referred to as C and Mn, the amounts of C and Mn satisfy $-6.5 \times C + 16.5 \leq Mn \leq -20 \times C + 30$.

10. The austenitic wear-resistant steel plate according to claim 6, wherein, as the chemical composition, when the amounts of C and Mn by mass % are respectively referred to as C and Mn, the amounts of C and Mn satisfy $-6.5 \times C + 16.5 \leq Mn \leq -20 \times C + 30$.

* * * * *